United States Patent [19]

Blum

[11] Patent Number: 5,064,360

[45] Date of Patent: Nov. 12, 1991

[54] SURGE CHAMBER FOR SWING VALVE GROUT PUMPS

[75] Inventor: Kenneth J. Blum, Parkville, Mo.

[73] Assignee: Berkel & Co. Contractors, Inc., Bonner Springs, Kans.

[21] Appl. No.: 553,236

[22] Filed: Jul. 16, 1990

[51] Int. Cl.[5] ..... F04B 7/00

[52] U.S. Cl. ..... 417/519; 417/540; 417/900; 137/568

[58] Field of Search ..... 417/540, 542, 900, 519; 138/26; 137/207, 568

[56] References Cited

U.S. PATENT DOCUMENTS

| | | | |
|---|---|---|---|
| 2,720,220 | 10/1955 | Gratzmuller | 417/540 |
| 3,131,721 | 5/1964 | Allen | 137/568 |
| 3,963,385 | 6/1976 | Caban | 417/900 |
| 3,989,420 | 11/1976 | Taylor | 417/900 |
| 4,057,373 | 11/1977 | Schwing | 417/900 |
| 4,177,023 | 12/1979 | Kamiya et al. | 417/540 |
| 4,311,302 | 1/1982 | Heyer et al. | 188/314 |
| 4,345,715 | 8/1982 | Van Craenenbroeck | 137/568 |
| 4,880,365 | 11/1989 | Austin | 417/900 |

FOREIGN PATENT DOCUMENTS

| | | | |
|---|---|---|---|
| 688609 | 6/1964 | Canada | 417/540 |
| 3806464 | 9/1989 | Fed. Rep. of Germany | 417/540 |

*Primary Examiner*—Richard A. Bertsch
*Assistant Examiner*—Michael I. Kocharov
*Attorney, Agent, or Firm*—Hovey, Williams, Timmons & Collins

[57] ABSTRACT

Improved apparatus (10) for pumping of a viscous, flowable material which minimizes the problem of large pressure fluctuations in downstream conduits (16). The apparatus (10) preferably includes a twin piston cement pump (12) and a flexible material delivery conduit (16). A surge control apparatus (14) operatively couples the pump (12) and the conduit (16). The surge control apparatus (14) includes a primary material-conveying body (40) with an elongated surge chamber (46) extending outward from the primary body (40). The surge chamber (46) includes a slidable piston (48) and means for filling a portion of the chamber with a pressurized fluid (62).

8 Claims, 2 Drawing Sheets

SURGE CHAMBER FOR SWING VALVE GROUT PUMPS

BACKGROUND OF THE INVENTION

1. Field of the Invention

This invention is broadly concerned with improved apparatus for the pumping of viscous, flowable materials such as grout or cement. More particularly, it is concerned with using a surge chamber in conjunction with typical large twin piston cement pumps in order to minimize the pressure fluctuations in downstream grout conveying lines.

2. Description of the Prior Art

Devices for pumping various materials such as cement or grout are widely used as a means to distribute such materials over elevated regions or to deliver these materials to areas which are not easily accessible. Typical pumps of this nature are devices with twin pistons which, by the alternating motion of each piston, send discrete charges of material through a material delivery conduit such as a flexible line. Because of these discrete charges produced by the pump, the pressure in the flexible line varies from close to ambient to as much as 800–900 pounds in as little as 0.5 seconds. This great fluctuation in pressure can cause the flexible line to expand and move, which in turn causes substantial wear in the line. This wear makes it necessary to replace the line more often than is desirable and, because these lines are expensive, this can drive up the operating costs for users of such pumps. In addition to this economic consequence, there is also a significant safety hazard presented if a grout line breaks during service.

SUMMARY OF THE INVENTION

The present invention overcomes the problem outlined above and provides an improved apparatus for pumping of a viscous, flowable material. Broadly speaking, the apparatus of the invention includes pumping means having structure for holding the material to be pumped, and an outlet for delivery of a pressurized output flow of this material. A flexible material delivery line for receiving the output flow, and for delivering the material to the desired location, also forms a part of the preferred apparatus. Finally, means for minimizing undesirable pressure fluctuations is also provided, and includes a surge control apparatus operatively coupled between the pump outlet and the flexible line.

In preferred forms, the pumping means is a twin-cylinder reciprocating pump of the type commercialized by Schwing America Inc. (models 750-15 or 750-18). The flexible line can be of any conventional commercial type. The surge control apparatus includes an elongated surge chamber which preferably extends upward from a primary body operatively coupled between the pump and flexible line. The surge chamber includes a slidable surge piston and means for filling a portion of the surge chamber above the piston with a pressurized fluid such as nitrogen gas.

DESCRIPTION OF THE PREFERRED EMBODIMENT

Figure 1:
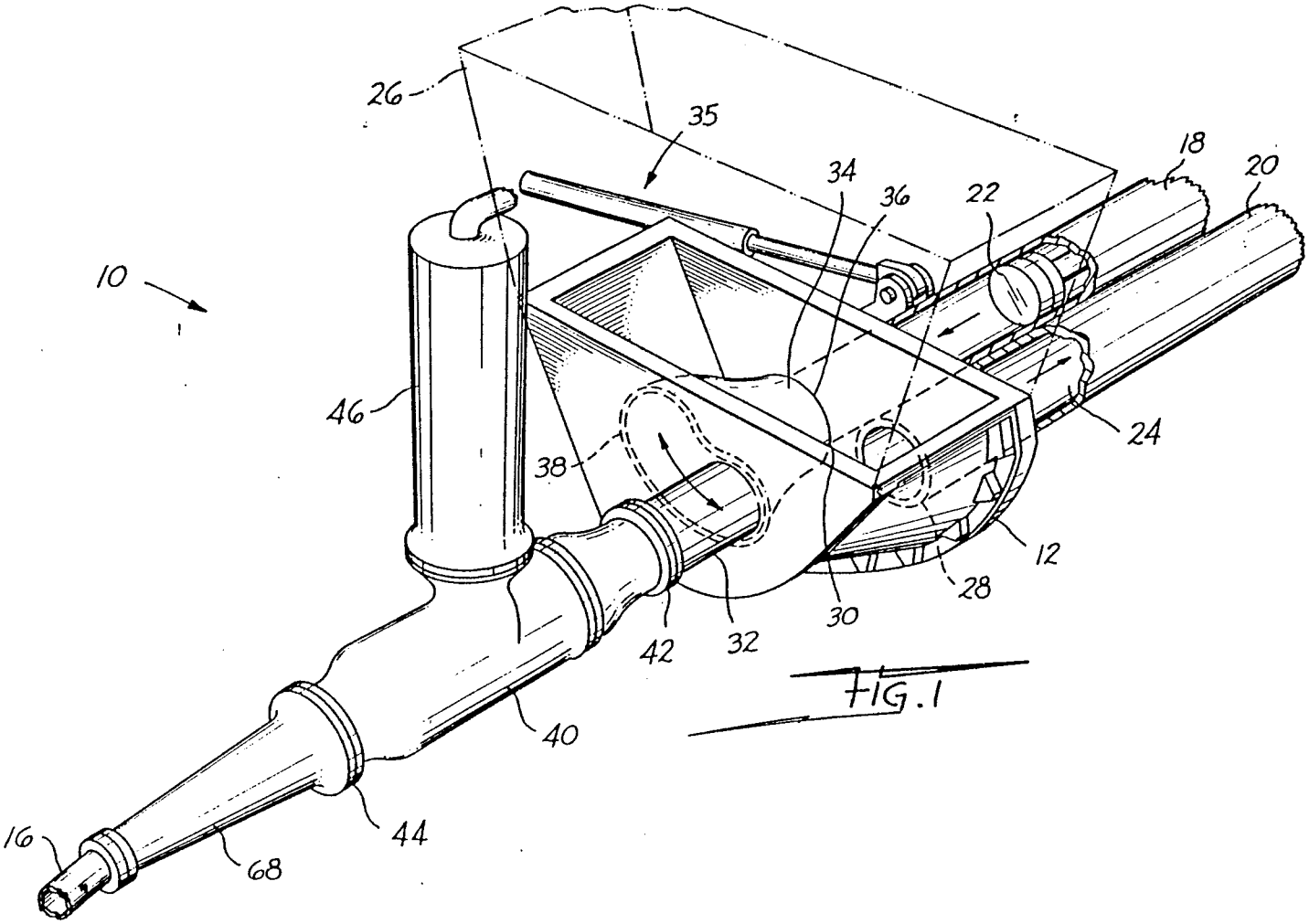
FIG. 1 is an essentially schematic, isometric view of the preferred pumping/surge chamber apparatus of the invention.

Referring now to the drawings, and particularly FIG. 1, pump/surge control apparatus broadly referred to by the numeral 10 is illustrated. The apparatus 10 includes a twin piston pump 12 together with an intermediate surge control apparatus 14, illustrated in FIG. 2, and a terminal delivery line 16.

In more detail, the pump 12 as illustrated in FIG. 1 is a twin-piston pump sold by Schwing America, Inc. The pump 12 has a pair of juxtaposed reciprocable piston/-tube assemblies, each comprising a tube 18 or 20 having a reciprocable pump piston 22 or 24. Moreover, the overall pump includes a hopper 26 designed to hold viscous material adjacent to the tube outlets 28, 30 and in alternate communication with tubes 18, 20. The hopper 26 also has a tubular outlet 32 remote from the tube outlets 28, 30. The pump 12 also includes a shiftable valve element 34 with a relatively small inlet end 36 and a larger outlet end 38. Conventional means 35 is provided for alternately moving the element 34 in both a translatory and pivotal fashion so as to provide for alternate communication of the inlet end 36 with each of the tube outlets 28, 30. During the alternating motion of the element 34, the outlet end 38 of the element 34 maintains constant communication with the tubular outlet 32 of the pump 12.

In the operation of the pump 12, material from the hopper 26 is pulled into a tube 18, 20 via a tube outlet 28, 30 on the return stroke of a pump piston 22, 24. Subsequently, the material pulled into a tube 18, 20 is pushed out of the respective tube 18, 20 on the forward stroke of the pump piston 22, 24. Before the forward stroke of a pump piston 22, 24, the inlet end 36 of the valve element 34 shifts to the tube outlet 28, 30 of the tube 18, 20 containing the pump piston 22, 24 about to begin its forward stroke. With the valve element 34 in this position, the material can be expelled out of the respective tube 18, 20 through the tubular outlet 32. Thus, the inlet end 36 of the valve element 34 only communicates with a tube outlet 28, 30 of a tube 18, 20 containing a pump piston 22, 24 in its forward stroke. The outlet end 38 of the valve element 34, however, is always in communication with the tubular outlet 32.

Figure 2:
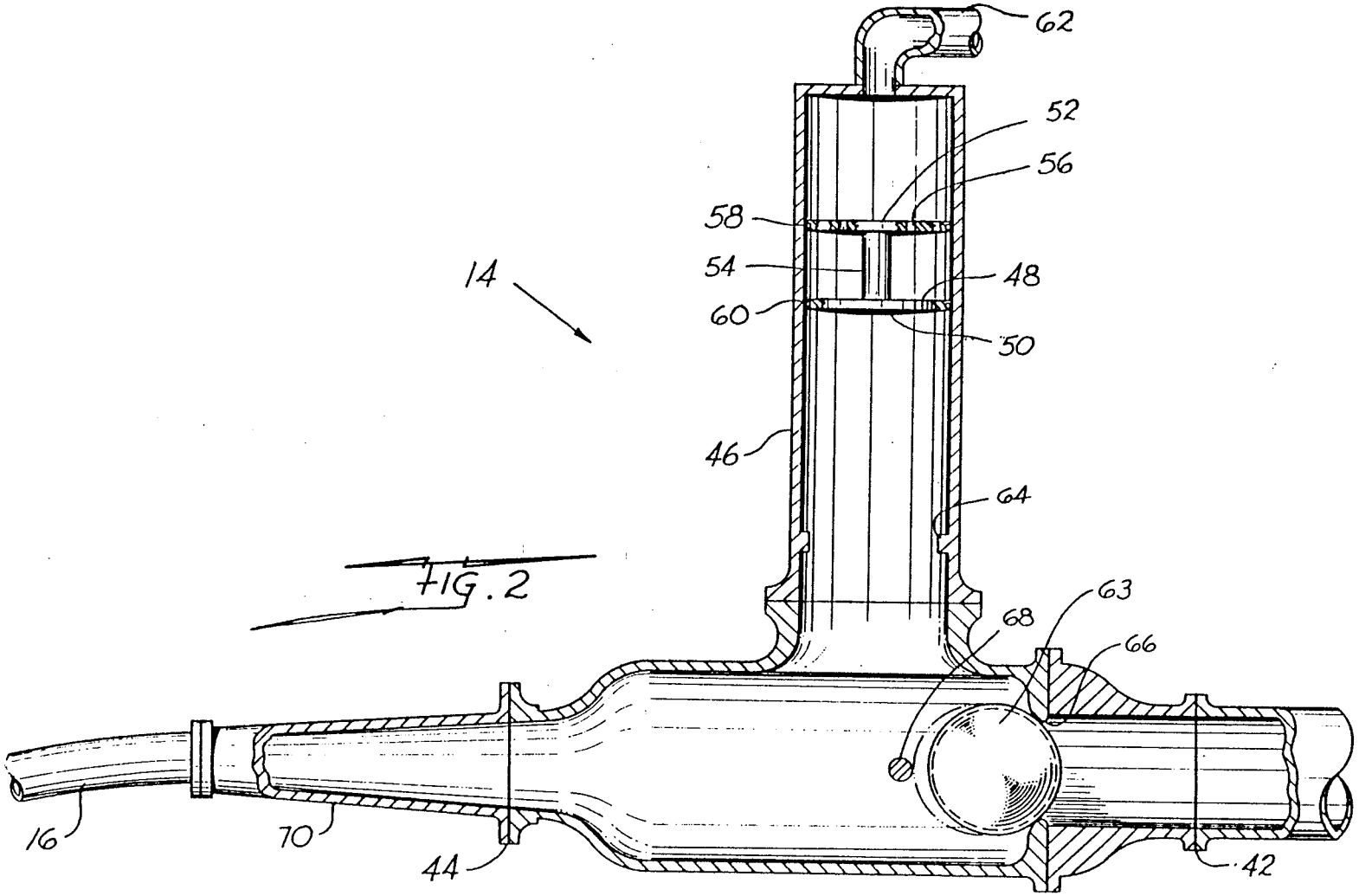
FIG. 2 is a vertical sectional view of the surge chamber apparatus.

The surge control apparatus 14 is best illustrated in FIG. 2 and includes a primary material-conveying body 40 having an inlet end 42 and an outlet end 44. A one-way check valve device is situated near the inlet end 42 of the primary body 40. This device comprises a hollow metallic ball 63 situated between a ball seat 66 and a transverse rod 68 which serves as a ball stop. The outlet end 44 of the primary body 40 has an elongated, frustoconical coupler 70 serving to secure the flexible line 16 in place. Also included in the surge control apparatus 14 is an elongated, upright surge chamber 46 connected to the interior of the primary body 40. A slidable surge piston 48 is contained within the surge chamber 46. The surge piston 48 includes a first (lower) plate 50 and a second (upper) plate 52 interconnected by a central spindle 54. The upper plate 52 has a circular array of apertures 56 therethrough, along with a peripheral metallic wear ring 58. The lower plate 50 is imperforate, and is equipped with a peripheral, flexible O-ring 60. The section above surge piston 48 is filled with gaseous nitrogen, and a filling nipple 62 is secured to the upper end of the surge chamber 46. Near the bottom of the chamber 46 is a stop 64 which prevents the surge piston 48 from traveling out of the chamber 46.

In the operation of surge control apparatus 14, flowable material delivered from tubular outlet 32 enters the inlet end 42 and travels through the one-way check valve device presented by the rod 68, ball 63, and valve seat 66. Excess material passes from the primary body 40 upwardly into surge chamber 46, elevating surge piston 48 and compressing the nitrogen gas thereabove. During the transition period between the return and forward strokes of the pump pistons 22, 24, the pressure in the primary body 40 drops to near ambient. This low pressure below surge piston 48 allows the compressed nitrogen above surge piston 48 to expand and move surge piston 48 downwardly to expel material out of the surge chamber 46 and through the outlet end 44. By providing this delivery of material through the outlet end 44 during the transition period of the pump pistons 22, 24, a near constant flow of material is provided and the problem of great pressure fluctuations in the flexible line 16 is thus minimized.

The one-way check valve device of surge control apparatus 14 operates to prevent back flow of material into the pump 12 during operation. This is accomplished by pressure from the downward movement of surge piston 48 forcing the ball 63 against the ball stop 66 thereby closing off access between the primary body 40 and pump 12 and thus not allowing any material to flow back into the pump 12.

During operation of the surge chamber 46, the apertures 56 of the upper plate 52 of the surge piston 48 allow the pressure in the chamber 46 above the surge piston 48 to equalize with the pressure in the space between the upper plate 52 and the lower plate 50 of the surge piston 48. This prevents a large pressure differential from developing above and below the lower plate 50. By maintaining a small pressure differential on each side of the lower plate 50, a flexible O-ring 60 can be used as a seal in lieu of a high pressure sealing ring.

I claim:

1. Apparatus for pumping of a viscous, flowable material, comprising:

a pumping device comprising a pair of material-receiving tubes each presenting a material outlet, a reciprocable piston within each tube and alternately shiftable for delivery of material towards and out of said tube outlets, and valve means including a valve outlet and a shiftable valve element in constant communication with said valve outlet and movable for selective communication with said tube outlets; and surge control apparatus operatively coupled with said valve outlet and comprising a primary material-conveying body in communication with said valve outlet and adapted for coupling with an elongated material delivery conduit;

an elongated surge chamber connected to and in communication with the interior of said primary body and having an outermost end remote from said body;

a slidable piston presenting an operating face communicating with the interior of said body and an opposed trailing face, said piston being within said chamber and shiftable along the length thereof, means for filling the portion of said chamber between said piston trailing face and said chamber outermost end with a pressurized fluid, said slidable piston comprising a first plate presenting said operating face, a second plate spaced from said first plate and presenting said trailing face, and means interconnecting said spaced first and second plates, there being means for substantially equalizing the pressures within said chamber portion and in the region between said first and second plates;

one-way check valve means within said body for permitting flow of said material from said valve outlet while preventing flow of said material from the body into said valve outlet.

2. Pumping apparatus as set forth in claim 1, said second plate having an aperture therethrough for equalizing the pressures within said chamber portion and in the region between said first and second plates.

3. Pumping apparatus as set forth in claim 1, said one-way check valve means comprising a valve seat within said body, a valve ball engagable with said valve seat, and stop means for limiting the movement of said valve ball.

4. Pumping apparatus as set forth in claim 1, said one-way check valve means being located between said valve outlet and said surge chamber.

5. Pumping apparatus as set forth in claim 1, said surge chamber extending upwardly from said primary body.

6. Surge chamber apparatus adapted for coupling with the outlet of a concrete or grout pump, said apparatus comprising:

a primary body presenting an inlet adapted to be connected with said pump outlet, and a primary body outlet adapted for connection with an elongated conduit;

an elongated surge chamber connected to and in communication with said primary body and having an outermost end remote from the primary body;

a piston within said chamber and slidable along the length thereof, said piston presenting a pair of spaced apart plates proximal to and remote from said body and respectively presenting an operating face and a trailing face;

means for filling the portion of said chamber between said trailing face and said chamber outermost end with a pressurized fluid;

means for equalizing the pressures within said chamber portion and between said piston plates; and one-way check valve means within said primary body for permitting flow of concrete or grout from said valve outlet into and through the primary body, and for preventing return flow of concrete or grout from the primary body into said valve outlet.

7. Surge chamber apparatus as set forth in claim 6, said one-way check valving means comprising structure defining a valve seat, a valve ball engagable with said seat, and means for limiting the movement of said valve ball.

8. Surge chamber apparatus as set forth in claim 6, said pressure-equalizing means comprising structure defining an aperture through said piston plate remote from said body.

* * * * *